US005603180A

United States Patent [19]

Houze

[11] Patent Number: 5,603,180

[45] Date of Patent: Feb. 18, 1997

[54] HAND GUN WITH REMOTELY CONTROLLED SAFETY SYSTEM

[76] Inventor: Wade L. Houze, 2327 Timberleaf, Ingleside, Tex. 78362

[21] Appl. No.: 526,439

[22] Filed: Sep. 11, 1995

[51] Int. Cl.[6] ..... F41A 17/00

[52] U.S. Cl. ..... 42/70.11; 42/1.01; 42/70.01; 42/84; 89/1.11

[58] Field of Search ..... 42/70.11, 1.01, 42/70.01, 84; 89/1.11

[56] References Cited

U.S. PATENT DOCUMENTS

| | | | |
|---|---|---|---|
| 3,545,116 | 12/1970 | Babington | 42/1.16 |
| 3,655,192 | 4/1972 | Hall et al. | 273/101.1 |
| 3,939,679 | 2/1976 | Barker et al. | 70/277 |
| 4,003,152 | 1/1977 | Barker et al. | 42/70 R |
| 4,089,195 | 5/1978 | Lai | 70/16 |
| 4,220,443 | 9/1980 | Bear | 431/91 |
| 4,488,370 | 12/1984 | Lemelson | 42/70 R |
| 4,682,435 | 7/1987 | Heltzel | 42/70.01 |
| 4,811,775 | 3/1989 | Sun | 70/16 |
| 4,842,277 | 6/1989 | Lacroix | 273/84 ES |
| 4,843,336 | 6/1989 | Kuo | 340/521 |

*Primary Examiner*—Charles T. Jordan
*Assistant Examiner*—Meena Chelliah
*Attorney, Agent, or Firm*—G. Turner Moller

[57] ABSTRACT

A safety system for a hand gun includes an electrode exposed through the handle. A high voltage source inside the handle connects to the electrode through a switch controlled by a receiver activated by a transmitter carried by an authorized person. If the authorized person loses possession of the hand gun, the transmitter is actuated thereby energizing the electrodes. If an unauthorized person is holding the hand gun within range of the transmitter, a high voltage shock is delivered through the electrodes. The unauthorized person thereupon drops the hand gun and it is no longer a threat to the authorized person.

11 Claims, 1 Drawing Sheet

FIG. 1
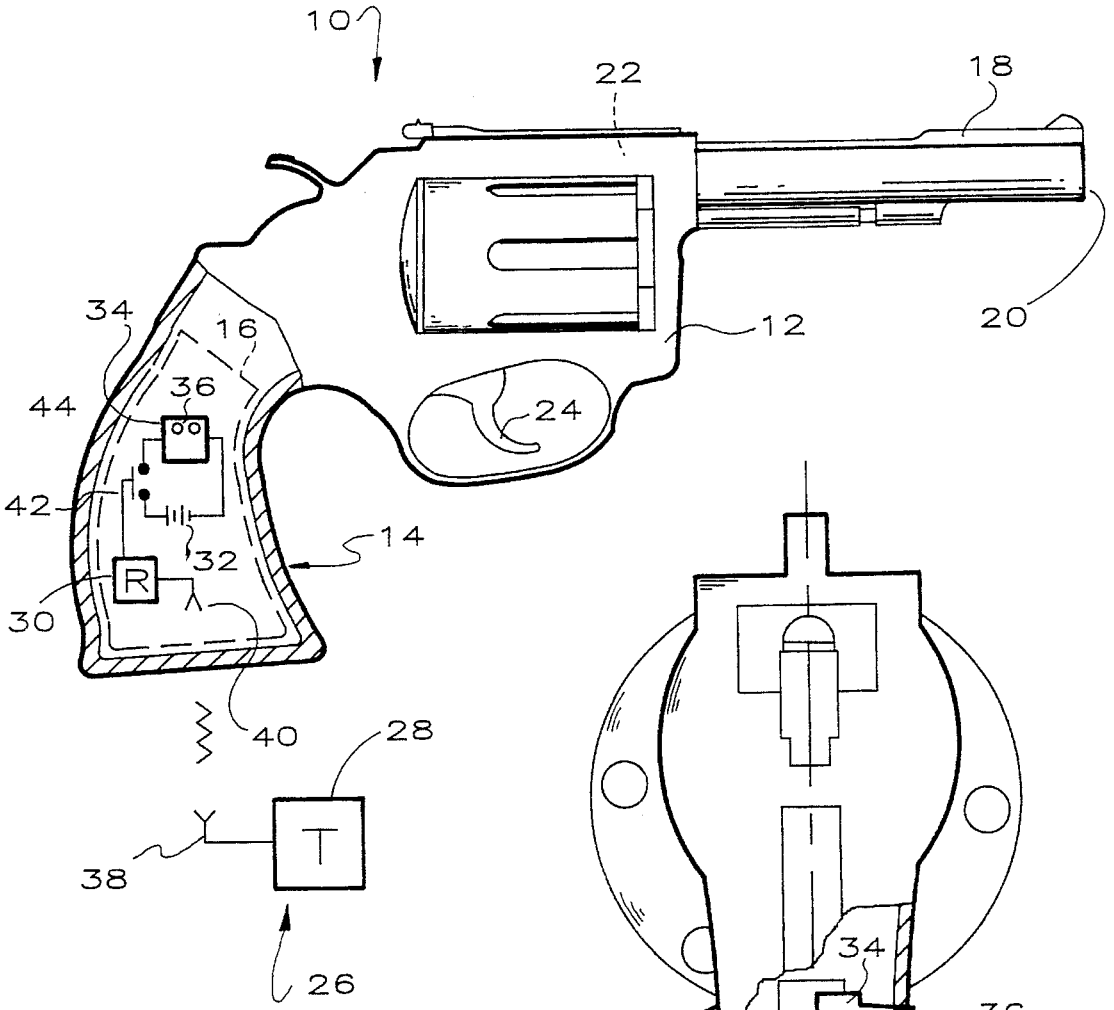
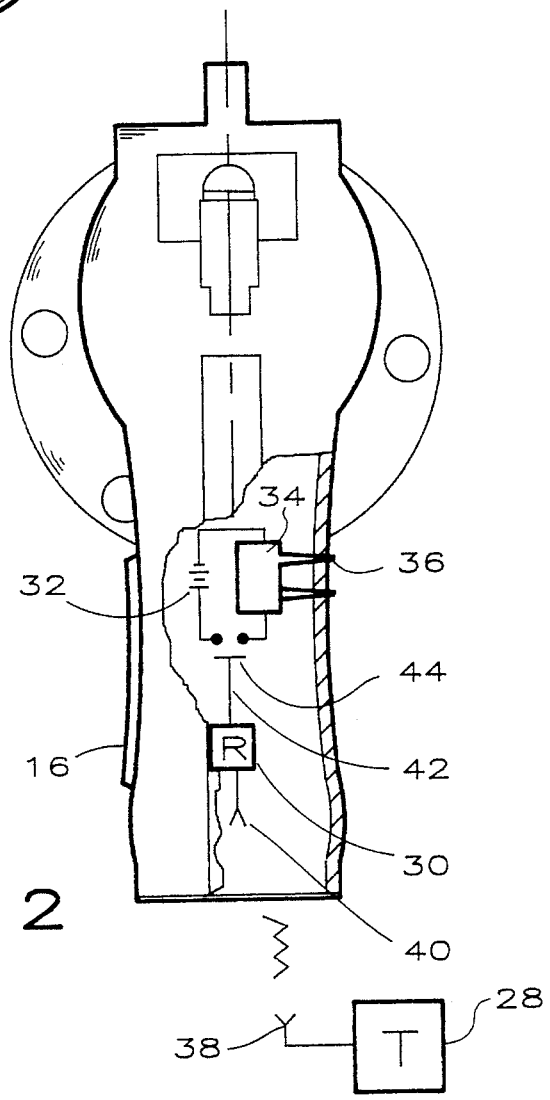
FIG. 2

HAND GUN WITH REMOTELY CONTROLLED SAFETY SYSTEM

This invention relates to a safety system for a hand gun, and more particularly, to a safety system for effectively disabling a hand gun by use of a remote transmitter.

BACKGROUND OF THE INVENTION

Law enforcement officers have many stresses and concerns about their daily professional lives. One of these concerns is being shot with their own hand gun which has been taken from them during a fight with someone they are trying to arrest. This concern is not without foundation because about twenty law enforcement officers are killed each year in this manner. A substantial motive for a number of law enforcement officers who lift weights is being able to defend themselves in fights, retain possession of their own hand guns and not be shot with them.

This concern has been recognized. A number of proposals have been made to provide hand guns with a means for disarming a hand gun in response to a remote transmitter. The hand guns shown in U.S. Pat. Nos. 3,939,679, 4,003,152 and 4,488,370 are normally inoperative and include a receiver connected to an electromechanical actuator for arming the weapon in response to the presence of a signal from a remote transmitter worn by the authorized person. When the weapon is moved outside the range of the transmitter, it becomes inoperative. The opposite technique is shown in U.S. Pat. No. 4,682,435 where the hand gun is normally operative but is rendered inoperative upon receiving a signal from a transmitter worn by the authorized person.

Although these devices are clearly workable, they manifestly require the operation of electromechanical actuators and mechanical linkages and have not, for whatever reason, achieved acceptance in the market place.

Also of some interest relative to this invention are the disclosures in U.S. Pat. Nos. 4,089,195, 4,811,775 and 4,843,336.

SUMMARY OF THE INVENTION

In this invention, normally deenergized high voltage electrodes are exposed through the handle of a hand gun. In a convenient location inside the hand gun, a source of high voltage is connected to the electrodes through a normally open switch controlled by a receiver. A transmitter is carried by the authorized user or owner of the hand gun, typically a law enforcement officer. In the event the hand gun is wrested out of the control of the officer, the officer energizes the transmitter to deliver a signal to the receiver. The receiver acts to close a switch thereby connecting the high voltage source to the electrodes. Anyone holding the hand gun by the handle, or anyone grasping the handle, necessarily touches the high voltage electrodes or is sufficiently close to them to receive a high voltage discharge. This causes the person to drop the hand gun. Thus, the person using a hand gun equipped with this invention has the ability to prevent the weapon from being used against him even though it is out of his possession.

It is an object of this invention to provide an improved safety system for a firearm.

Another object of this invention is to provide a law enforcement officer with the capability of delivering a high voltage shock through the handle of his hand gun.

A further object of this invention is to provide a reliable technique for disabling a firearm out of one's possession.

Other objects and advantages of this description will become more apparent as this description proceeds, reference being made to the accompanying drawings and appended claims.

BRIEF DESCRIPTION OF THE DRAWINGS

FIG. 1 is a side broken view of a hand gun of this invention schematically illustrating the mechanism to cause an unauthorized person to drop the weapon; and FIG. 2 is an end broken view of the hand gun of FIG. 1.

DETAILED DESCRIPTION

Referring to FIGS. 1–2, there is illustrated a hand gun 10 of a conventional type having a frame 12 providing a handle 14 having hand grips 16, a barrel 18 having a muzzle 20 and a breech 22, means for delivering bullets to the breech and a trigger 24. A safety system 26 is provided to cause, in response to action by an authorized person, an unauthorized person to drop the hand gun 10.

The safety system 26 comprises a transmitter 28 carried by the owner or authorized user of the hand gun 10, a receiver/decoder 30 inside the hand gun 10, a battery 32, a high voltage transformer 34 and one or more electrodes 36 exposed through the handle 14.

The transmitter 28 is typically a radio frequency transmitter and may be of any suitable type, such as shown in U.S. Pat. Nos. 3,939,679, 4,003,152, 4,089,195, 4,488,370, 4,811,775 and 4,843,336 to which reference is made for a more complete description. In its simplest form, the transmitter 28 includes a single signal generator operating at any suitable frequency in the radio frequency range from a low audio range up to as high as 10 GHz. As desired, a suitable identifying code may be incorporated into the signal emitting from the transmitter 28 so the receiver/decoder 30 reacts only to a signal from a single predetermined transmitter 28. The signal from the transmitter 28 acts through an internal antenna 38 incorporated in a device worn by the authorized user of the hand gun 10. The transmitter 28 may be worn by the authorized person in any suitable manner, as on the belt, attached to the clothing, in a pocket, incorporated into a bracelet or the like.

The receiver/decoder 30 is equipped with an antenna 40 and is arranged to receive and decode, if necessary, the signal from the transmitter 28. The receiver/decoder 30 may be of any suitable type, such as shown in U.S. Pat. Nos. 3,939,679, 4,003,152, 4,089,195, 4,488,370, 4,811,775 and 4,843,336 to which reference is made for a more complete description. The receiver/decoder 30 delivers a signal on an output 42 to close an electronic switch 44 thereby closing a circuit including the battery 32 and the high voltage transformer 34. In this manner, a high voltage output is applied to the electrodes 36.

The high voltage transformer 34 may be of any suitable type and is well known in the art. The transformer 34 is selected to deliver a sufficient voltage and current to the electrodes 36 that will cause any person, however well motivated, to drop the hand gun 10. High voltage transformers of this type are incorporated into commercial articles known as stun guns and act to deliver well in excess of 25,000 volts to the electrodes. Typical stun guns now commercially available deliver in excess of 100,000 volts to the electrodes. No person, however well motivated, can retain a grip on the handle 14 of the hand gun 10 when experiencing voltages in the range of 25,000–100,000 volts through the electrodes 36.

The electrodes 36 are preferably exposed through the handle 14 so they contact the hand or fingers of any one gripping the hand gun 10. The electrodes 36 may be side-by-side as suggested in FIG. 1, one above another as suggested in FIG. 2 or any other suitable pattern. The unauthorized person holding the hand gun 10 does not have to touch the electrodes 36 to receive a jolt. It is sufficient that the hand be close to the electrodes 36, i.e. less than about an inch away.

Although the hand gun 10 is illustrated as of the revolver type, it will be apparent that the receiver/decoder 20, the switch 44, the battery 32 and the high voltage transformer 34 may be incorporated into a hand gun of the semi-automatic type in which rounds are feed to the breech 20 by an ammunition clip.

It will accordingly be seen that this invention provides a simple and inexpensive technique allowing a law enforcement officer to prevent his own hand gun from being used against him.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A hand gun comprising a handle, a barrel having a muzzle and a breech, means for delivering bullets to the breech and a trigger;

an electrode exposed through the handle;

a high voltage source inside the hand gun;

a receiver, inside the hand gun, for receiving a signal from a transmitter and providing an output; and means for connecting the high voltage source in circuit with the electrode in response to the output from the receiver.

2. The hand gun of claim 1 comprising a plurality of electrodes exposed through the handle.

3. The hand gun of claim 1 wherein the high voltage source has the capacity to deliver in excess of 25,000 volts to the electrode.

4. The hand gun of claim 1 wherein the high voltage source has the capacity to deliver in excess of 100,000 volts to the electrode.

5. The hand gun of claim 1 wherein the hand gun is a revolver.

6. A control system for a handgun of the type including a handle, a barrel having a muzzle and a breech, means for delivering bullets to the breech and a trigger, the control system comprising an electrode exposed through the handle;

a high voltage source out of circuit with the electrode;

a receiver for receiving a signal from a transmitter and providing an output; and means for connecting the high voltage source in circuit with the electrode in response to the output from the receiver.

7. The control system of claim 6 wherein the high voltage source has the capacity to deliver in excess of 25,000 volts to the electrode.

8. The hand gun of claim 6 wherein the high voltage source has the capacity to deliver in excess of 100,000 volts to the electrode.

9. A hand gun including a handle, a barrel having a muzzle and a breech, first means for delivering bullets to the breech, a trigger, and second means for selectively delivering a high voltage current through the handle sufficient to cause a person to drop the hand gun, the second delivering means comprises radio receiver means for receiving an input signal and energizing the delivering means in response to the signal.

10. The hand gun of claim 9 wherein the delivering means comprises means for selectively delivering in excess of 25,000 volts through the handle.

11. A method of controlling the operation of a firearm by an authorized person to prevent operation by an unauthorized person which comprises the steps of:

providing at least one normally deenergized high voltage electrode in a handle of the firearm;

generating a distinctive high frequency electromagnetic wave signal in response to action by the authorized person;

equipping the firearm with radio receiver means designed to receive the distinctive high frequency signal; and delivering high voltage current through the electrode when the handle is grasped by the unauthorized person in response to the radio receiver means receiving the distinctive high frequency signal.

* * * * *